United States Patent [19]

Ozu

[11] Patent Number: 4,522,038

[45] Date of Patent: Jun. 11, 1985

[54] REFRIGERATING CYCLE APPARATUS

[75] Inventor: Masao Ozu, Fuji, Japan

[73] Assignee: Tokyo Shibaura Denki Kabushiki Kaisha, Kawasaki, Japan

[21] Appl. No.: 498,783

[22] Filed: May 27, 1983

[30] Foreign Application Priority Data

Jun. 4, 1982 [JP] Japan ..... 57-96034

[51] Int. Cl.[3] ..... F25B 1/00

[52] U.S. Cl. ..... 62/228.5; 62/196.3; 417/299

[58] Field of Search ..... 62/196.3, 228.3, 228.5; 417/299

[56] References Cited

U.S. PATENT DOCUMENTS

| | | | |
|---|---|---|---|
| 3,224,662 | 12/1965 | Oldberg | 62/196.3 |
| 3,676,021 | 7/1972 | Warner | 417/299 |
| 3,767,328 | 10/1973 | Ladusaw | 417/299 |
| 4,137,726 | 2/1979 | Watada | 62/196.3 |
| 4,326,868 | 4/1982 | Ozu et al. | 62/196.3 |
| 4,344,297 | 8/1982 | Ueno et al. | 417/299 |

FOREIGN PATENT DOCUMENTS 52-38774 9/1977 Japan .

*Primary Examiner*—Ronald C. Capossela
*Attorney, Agent, or Firm*—Cushman, Darby and Cushman

[57] ABSTRACT

A refrigerating cycle apparatus has a compressor, a condenser, an evaporator, and a capillary tube. The condenser includes a compressor main body for compressing a refrigerant delivered therein, a valve hole, a groove for connecting the valve hole and a suction port of the compressor main body, a pipe for connecting the valve hole and a delivery port of the compressor main body, an aperture for connecting the valve hole and a suction port of the condenser, and a valve plug movably mounted in the valve hole. The valve plug is adapted to move between a first position where the pipe communicates with the aperture through the valve hole in accordance with a difference in pressure at the suction port and delivery port of the compressor when the compressor is in operation and a second position where the pipe does not communicate with the aperture through the valve hole when said compressor is stopped.

6 Claims, 7 Drawing Figures

REFRIGERATING CYCLE APPARATUS

BACKGROUND OF THE INVENTION

The present invention relates to a refrigerating cycle apparatus for cooling a refrigeration chamber such as a refrigerator by driving/stopping a compressor.

In general, the refrigerating cycle apparatus of this type comprises a compressor, a condenser, a pressure reducing device, and an evaporator, which are connected to each other in the order named. The refrigeration chamber is cooled to a predetermined temperature, and then the compressor is stopped. Thereafter, a hot gas from the condenser gradually flows into the evaporator. A thermosensor disposed in the vicinity of the evaporator is turned on so as to start the compressor before the temperature of the refrigeration chamber has risen to a predetermined temperature. As a result, desired temperature control of the refrigeration chamber cannot be performed, resulting in high power consumption.

In order to solve the above problem, a refrigerating cycle apparatus has been proposed as shown in FIG. 1 wherein an electromagnetic valve 12 is disposed between a condenser 10 and a compressor 11. According to this apparatus, the electromagnetic valve 12 is actuated at the same time that the compressor 11 is stopped to prevent the hot gas from flowing from the compressor 11 to an evaporator 13 through the condenser 10. While the refrigerating cycle apparatus of this type is not in operation (i.e., while the compressor 11 is not operated), the evaporator 13 is continuously energized, resulting in high power consumption.

SUMMARY OF THE INVENTION

It is an object of the present invention to provide a low-power compact refrigerating cycle apparatus for accurately performing temperature control.

BRIEF DESCRIPTION OF THE DRAWINGS

FIGS. 2 to 7 show a refrigerating cycle apparatus according to an embodiment of the present invention, in which FIG. 2 is a schematic diagram of the apparatus as a whole, FIG. 3 is a longitudinal sectional view showing part of a compressor thereof, FIG. 4 is a cross-sectional view showing part of the compressor, FIGS. 5 and 6 are sectional views showing different operating conditions of a pressure regulating valve, respectively, and FIG. 7 is a graph showing the relationship between the operating condition of the compressor and the inflow pressure vs the outflow or delivery pressure.

DETAILED DESCRIPTION OF THE PREFERRED EMBODIMENT

A refrigerating cycle apparatus according to an embodiment of the present invention will be described with reference to the accompanying drawings.

Figure 1:
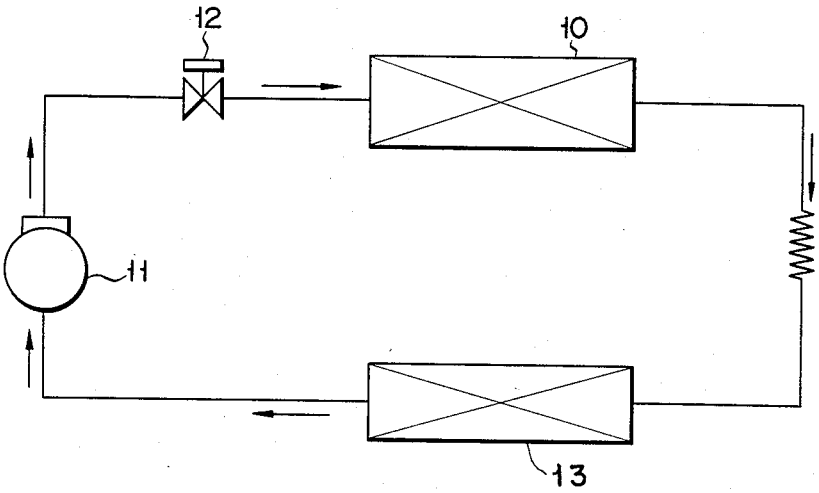
FIG. 1 PRIOR ART
FIG. 1 is a diagram showing a conventional refrigerating cycle apparatus.
Figure 2:
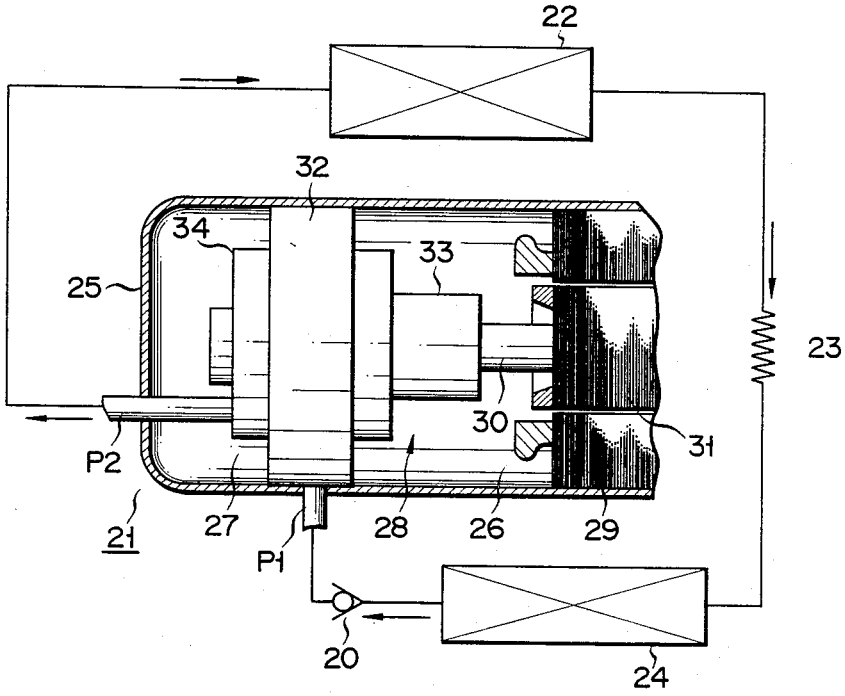

Referring to FIG. 2, reference numeral 21 denotes a compressor. A delivery port of the compressor 21 is connected to an inflow port of a condenser 22. A delivery port of the condenser 22 is connected to an inflow port of an evaporator 24 through a capillary tube 23. A delivery port of the evaporator 24 is connected to a suction port of the compressor 21 through a check valve 20. The check valve 20 allows flow of a refrigerant from the evaporator 24 to the compressor 21 and prevents its inverse flow.

Figure 3:
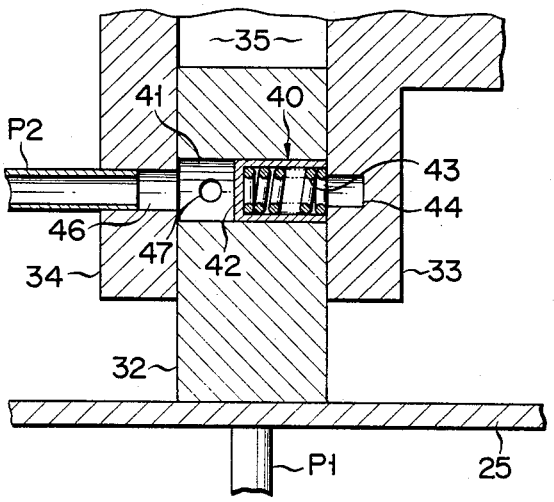
Figure 4:
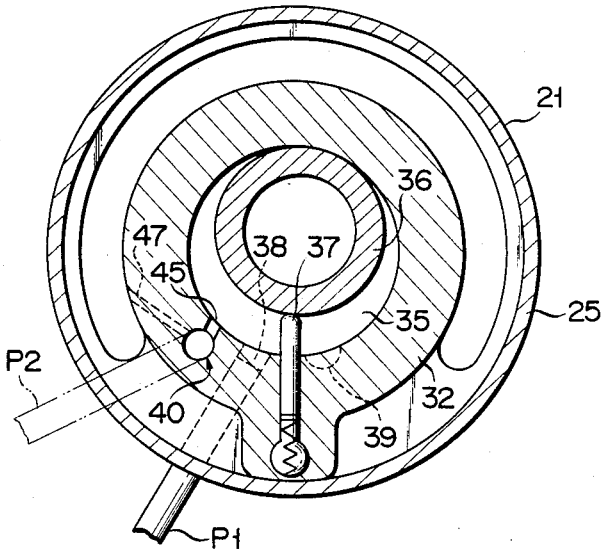

The compressor 21 comprises an electric rotary sealed compressor. The compressor 21 has a cylindrical sealed housing 25 and an electric compressor main body 28 disposed therein. The main body 28 comprises a motor member 26 and a compressor member 27. The motor member 26 comprises a stator 29 fixed on the inner surface of the housing 25 and a rotor 31 surrounded by the stator 29 and coaxial with a rotating shaft 30. When the stator 29 is energized, the rotor 31 is rotated, as is well known, thereby rotating the rotating shaft 30. A circular cylinder chamber 35 (FIGS. 3 and 4) is formed at the center of the compressor member 27. The compressor member 27 comprises: a circular cylinder 32 fixed in the housing 25; and a main bearing 33 and a subbearing 34 which are respectively mounted at two ends of the cylinder 32 so as to seal a cylinder chamber 35. The bearings 33 and 34 rotatably support the rotating shaft 30 which extends through the cylinder chamber 35. As shown in FIG. 4, a roller 36 is mounted in the cylinder chamber 35. The roller 36 is eccentrically mounted on the rotating shaft 30. Upon rotation of the rotating shaft 30, the roller 36 is eccentrically rotated in the cylinder chamber 35 along the inner surface thereof. A blade 37 is slidably mounted in the cylinder chamber 35 such that the distal end of the blade 37 extends into the cylinder chamber 35. The blade 37 is biased toward the cylinder chamber 35 by a spring which is hooked at the proximal end thereof. The distal end of the blade 37 constantly abuts against the surface of the roller 36. The cylinder chamber 35 is thus divided by the blade 37 into an inflow compartment and a delivery compartment. A suction port 38 extending outward through the walls of the housing 25 and the cylinder 32 is formed in the vicinity of the blade 37 in the inflow compartment of the cylinder chamber 35. The suction port 38 is connected to the delivery port of the evaporator 24 through a first refrigerant tube or a suction-side refrigerant tube P1. A delivery port 39 extending through the cylinder 32 and into the housing 25 is formed in the vicinity of the blade 37 in the delivery compartment of the cylinder chamber 35. A differential pressure regulating valve 40 is disposed in the cylinder 32. The valve 40 has a valve hole 41 formed in a portion of the cylinder 32 in the vicinity of the suction port 38 so as to extend parallel to the axis of the cylinder 32 and a valve plug 42 slidably mounted in the valve hole 41. The valve plug 42 comprises a cylindrical member one end (corresponding to the main bearing 33) of which is open and the other end (corresponding to the subbearing 34) of which is closed. A compression spring 43 which has one end fixed to the main bearing 33 is mounted inside the cylindrical member so as to bias the valve plug 42 in the direction toward the subbearing 34. A circular recess 44 which has a diameter smaller than that of the valve hole 41 is formed coaxially therewith at one end face of the main bearing 33 so as to communicate with the valve hole 41. The recess 44 communicates with the suction port 38 of the cylinder chamber 35 through a groove 45 formed in the main bearing 33. A delivery port 46 is formed in the subbearing 34 so as to communicate with the valve hole 41. One end of a refrigerant pipe P2 is connected to the inflow port of the condenser 22, and the other end thereof is connected to the delivery port 46. An auxiliary delivery aperture 47 is formed in the cylinder 32. One end of the auxiliary delivery aperture 47 is open at a portion of the valve hole 41 which is in the vicinity of the subbearing 34, and the other end thereof communicates with the housing 25.

The operation of the refrigerating cycle apparatus having the above construction will be described hereinafter.

When the compressor 21 is driven, the compressor 21 receives and compresses the refrigerant gas in the same manner as in a general refrigerating cycle. The compressed refrigerant gas is then supplied to the condenser 22 and is condensed and liquefied by the condenser 22. The liquefied refrigerant is then reduced in pressure through the capillary tube. The refrigerant liquid is then evaporated by the evaporator 24 and the latent heat of vaporization provides the refrigeration effect.

The operation of the compressor 21 during the refrigerating cycle will be described in detail.

Figure 5:
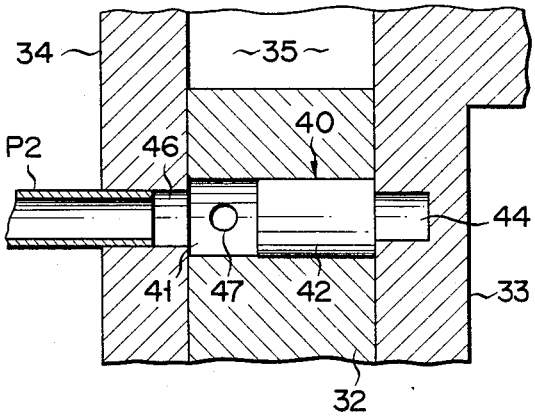

The liquefied refrigerant is supplied from the refrigerant pipe P1 to the cylinder chamber 35 through the suction port 38. This refrigerant is compressed by eccentric rotation of the roller 36 in the cylinder chamber 35 to a predetermined pressure. Thereafter, the compressed refrigerant is delivered into the housing 25 through the delivery port 39. In this condition, an inequality $Ps < Pd$ is established, where Ps is the pressure as the refrigerant passes through the suction port 38 and Pd is the pressure as the refrigerant passes through the delivery port 39. In the differential pressure regulating valve 40, the pressure at the auxiliary delivery aperture 47 is higher than that at the recess 44, so that the valve plug 42 is moved to the side of the recess 44 against the biasing force of the compression spring 43 as an auxiliary spring, as shown in FIG. 5. In this condition, one end face of the valve plug 42 abuts against the main bearing 33 so as to open the auxiliary delivery aperture 47. The aperture 47 communicates with the valve hole 41. As a result, the compressed refrigerant gas delivered into the housing 25 is introduced into the valve hole 41 through the auxiliary delivery aperture 47 and is delivered to the delivery refrigerant pipe P2 through the delivery port 46 as a guide aperture.

Figure 6:
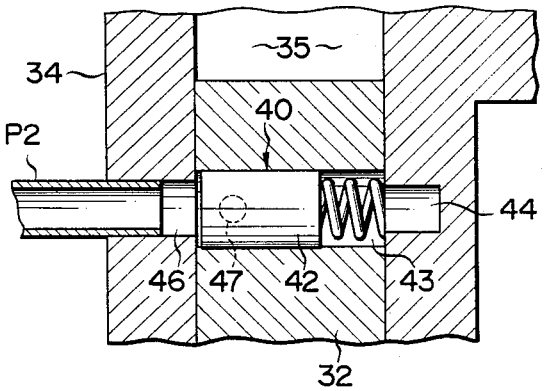

When the compressor 21 is stopped, the pressure (inflow pressure) Pd of the refrigerant as it passes through the suction port 38 is increased, while the pressure (delivery pressure) Ps of the refrigerant as it passes through the delivery port 39 is decreased, thereby decreasing the difference between the pressures Pd and Ps. When the pressure difference falls within a given range, the auxiliary spring 43 overcomes this pressure difference, so that the valve plug 42 is gradually moved by the spring 43 toward the subbearing 34. When the valve plug 42 is moved for a distance exceeding a predetermined distance, the auxiliary delivery aperture 47 is closed by the valve plug 42. As a result, the aperture 47 does not communicate with the valve hole 41. Finally, as shown in FIG. 6, the other end face of the valve plug 42 abuts against the subbearing 34, so that the auxiliary delivery aperture 47 is kept closed. When the compressor 21 is deenergized, the compressed refrigerant gas in the cylinder chamber 35 and the housing 25 does not flow to the evaporator 24 through the condenser 22.

Figure 7:
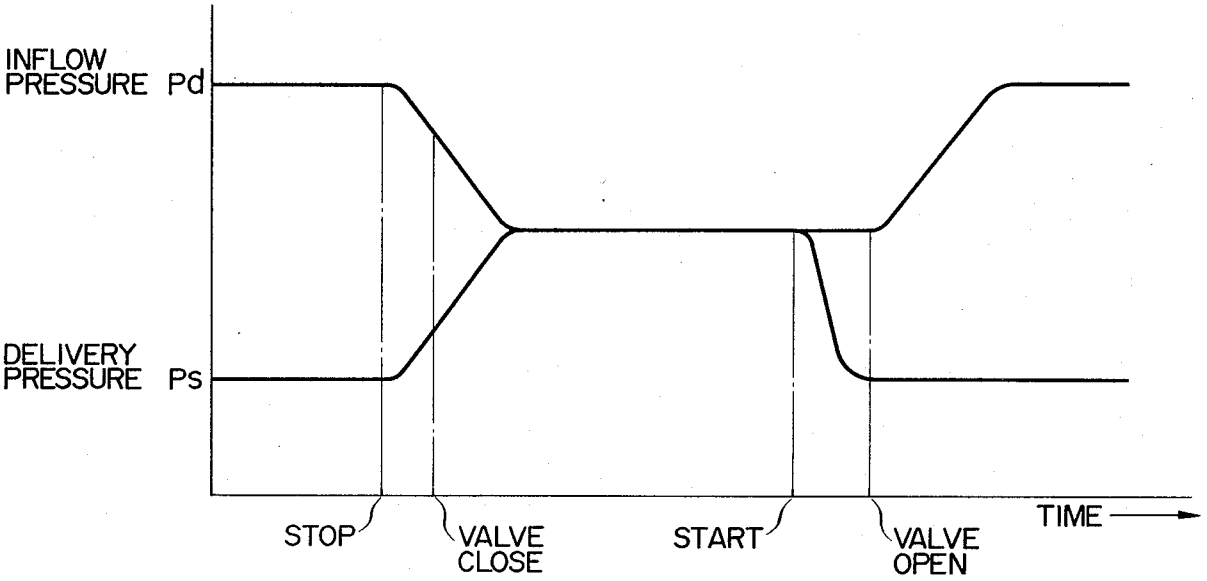

When the compressor 21 is energized again, the pressure Ps is abruptly decreased, and the difference between the pressures Ps and Pd is increased. The valve plug 42 is moved by the pressure difference toward the recess 44 against the biasing force of the auxiliary spring 43 so as to open the auxiliary delivery aperture 47, as shown in FIG. 5. As a result, the refrigerant gas compressed in the cylinder chamber 35 is delivered to the delivery refrigerant pipe P2 through the auxiliary delivery aperture 47 and the delivery port or guide aperture 46, thereby completing the refrigerating cycle. The relationship between the inflow pressure Pd and the delivery pressure Ps in a cycle of driving/stopping/-driving of the compressor 21 is shown in FIG. 7.

A rotary compressor is used as the compressor in the above embodiment. However, the compressor is not limited to the compressor of this type. A pressure reducing valve, for example, other than the capillary tube may be used as the pressure reducing device. A first connecting means for directly connecting the valve hole and the inflow port of the compressor main body is constituted by the groove and the recess which are formed in the main bearing. However, a single aperture may be used in place of the set of groove and recess. Furthermore, the first connecting means may comprise a pipe or tube disposed in any portion other than the main bearing. A second connecting means is not limited to a combination of delivery and guide apertures, and a third connecting means is not limited to the guide aperture.

As is apparent from the above description, in the refrigerating cycle apparatus of the present invention, a valve mechanism is disposed integrally with the compressor so as to open/close in accordance with a difference between the inflow and delivery pressures of the compressor. By this valve mechanism, the hot gas cannot flow from the compressor to the evaporator through the condenser when the compressor is stopped. Since the valve mechanism is driven by the pressure difference, power is not be wasted. Furthermore, by using the compressor described above, no electromagnetic valve need be disposed between the compressor and the condenser, thereby obtaining a compact apparatus.

What is claimed is:

1. A refrigerating cycle apparatus having a compressor having suction and delivery ports, a condenser connected to said compressor delivery port, an evaporator connected to said compressor suction port, and a pressure reducing device connected between said condenser and said evaporator, said compressor comprising:

a compressor main body defining said suction and delivery ports, said main body being for compressing a refrigerant delivered therein;

means for defining a valve hole;

first connecting means for connecting said valve hole and said compressor suction port;

second connecting means for connecting said valve hole with said compressor delivery port;

third connecting means for connecting said valve hole and a suction port of said condenser; and a valve plug movably mounted in said valve hole, said valve plug being adapted to move between a first position where said second connecting means communicates with said third connecting means through said valve hole in accordance with a difference in pressure at said suction port and said delivery port of said compressor when said compressor is in operation and a second position where said second connecting means does not communicate with said third connecting means through said valve hole when said compressor is stopped.

2. An apparatus according to claim 1, wherein said compressor has biasing means for moving said valve plug into the second position when said compressor is stopped.

3. An apparatus according to claim 2, wherein said compressor has a housing which houses said compressor main body and a motor member which is mounted in said housing, and said compressor main body has a cylinder defining a cylinder chamber therein and a roller disposed in said cylinder chamber so as to be eccentrically rotatable upon rotation of said motor member, thereby compressing the refrigerant.

4. An apparatus according to claim 3, wherein said compressor main body has first and second bearings which clamp said cylinder therebetween, said first and second bearings closing said valve hole at each of two ends thereof, respectively.

5. An apparatus according to claim 4, wherein said first connecting means has a groove formed in said first bearing and a recess formed opposing said valve hole, said second connecting means has a delivery port which communicates said cylinder chamber defined by said cylinder with said housing and an auxiliary delivery aperture which communicates said housing defined by said cylinder with said valve aperture, and said third connecting means has a guide aperture which communicates said valve hole formed in said second bearing with said condenser.

6. An apparatus according to claim 5, wherein said biasing means comprises a spring for biasing said valve plug toward said second bearing, said spring being disposed between said valve plug and said first bearing.

* * * * *